United States Patent [19]

Mayer

[11] 4,109,612

[45] Aug. 29, 1978

[54] ELECTROLESS PLATING APPARATUS FOR DISCRETE MICROSIZED PARTICLES

[75] Inventor: Anton Mayer, Los Alamos, N. Mex.

[73] Assignee: The United States of America as represented by the United States Department of Energy, Washington, D.C.

[21] Appl. No.: 613,849

[22] Filed: Sep. 16, 1975

[51] Int. Cl.[2] ..... B05C 3/04

[52] U.S. Cl. ..... 118/417; 118/425; 134/141

[58] Field of Search ..... 118/417, 421, 423, 425; 134/141, 164, 201

[56] References Cited

U.S. PATENT DOCUMENTS

| | | | |
|---|---|---|---|
| 1,737,480 | 11/1929 | Troy | 134/141 X |
| 1,909,232 | 5/1933 | Soroka | 134/164 |
| 2,646,807 | 7/1953 | Martin | 118/425 X |
| 2,885,877 | 5/1959 | Denker | 134/141 X |
| 3,169,538 | 2/1965 | Arnaudin | 134/141 |

*Primary Examiner*—Dorsey Newton

*Attorney, Agent, or Firm*—Dean E. Carlson; Edward C. Walterscheid

[57] ABSTRACT

Method and apparatus are disclosed for producing very uniform coatings of a desired material on discrete microsized particles by electroless techniques. Agglomeration or bridging of the particles during the deposition process is prevented by imparting a sufficiently random motion to the particles that they are not in contact with each other for a time sufficient for such to occur.

1 Claim, 1 Drawing Figure

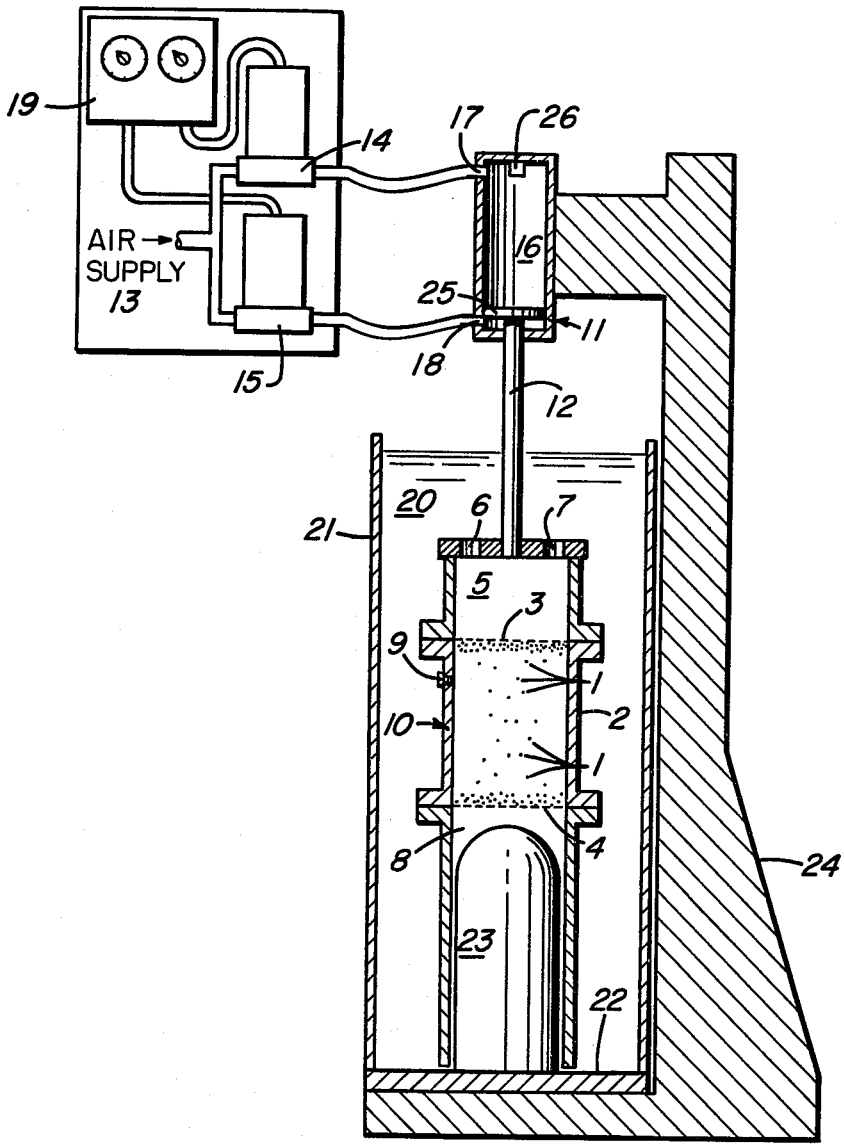
19
14
17
26
AIR
SUPPLY
13
16
25
11
18
15
12
20
6
7
21
5
3
9
1
10
2
1
8
4
24
23
22

ELECTROLESS PLATING APPARATUS FOR DISCRETE MICROSIZED PARTICLES

BACKGROUND OF THE INVENTION

This invention relates to method and apparatus for forming very uniform coatings on discrete microsized particles and more particularly to a method and apparatus for applying such coatings on discrete microsized particles by electroless techniques.

A mixture of deuterium (D) and tritium (T) is a preferred fuel for laser fusion, primarily because the least energy is required to cause these two isotopes to undergo thermonuclear reaction. It is desirable that the DT mixture acted upon by the laser radiation be as dense as possible. The optimum density is achieved by cooling the mixture sufficiently that it becomes a solid. This, however, requires temperatures below 20 K which imposes very severe constraints not only on the manufacture, but also on the handling of laser fusion targets.

Alternatively, hollow, spherical, DT-gas-filled targets with diameters ranging from 30 to greater than 200 μm and with contained fuel pressures varying from 10 to 1000 atm (at 298 K) are of interest for laser fusion. The primary gas-containment vessels of these targets are hollow microspheres called microcapsules. The targets are filled by diffusing DT fuel gas through the walls at elevated temperatures, taking advantage of the exponential temperature dependence of the permeability to allow the gas to be retained for useful times at room temperature. Thus, when the microcapsules are placed in a deuterium and tritium gas mixture a desired ratio at high pressure and elevated temperature, the deuterium and tritium readily enter the microcapsules and equilibrate to the surrounding gas pressure. When the microcapsules are cooled to room temperature, the diffusion rate through their walls is greatly reduced, so that the DT mixture within the microcapsules remains at high pressure for times which permit useful storage before the targets are irradiated by the laser.

To most effectively produce the compression of the DT fuel necessary for thermonuclear reaction, it is desirable that the fuel be surrounded by a pusher shell of high-Z metal. Presently available microcapsules are not composed of materials having the desired high-Z characteristics, so that it is necessary to coat them with a layer of high-Z metal. This metal shell of the laser fusion target must be fully dense and of very uniform thickness, with aspect ratios in the range of from 10/1 to 100/1. It should have a minimum tensile strength of 690 MPa.

It is well known in the art that electroless techniques are well suited to the deposition or plating of certain metals on various surfaces. Unfortunately, conventional electroless plating apparatus and methods have been found to be largely unsuccessful in producing metal coatings of the requisite thickness and uniformity requirements on microcapsules. A primary problem has been the tendency of the microcapsules to agglomerate and/or bridge during the coating process. By bridging is meant the joinder of the coatings of two or more microcapsules to form one common structure.

SUMMARY OF THE INVENTION

Agglomeration or bridging of discrete microsized particles subjected to electroless coating techniques is avoided and coatings of very uniform thickness are achieved by imparting a sufficiently random motion to the particles in the electroless solution. In a preferred embodiment, this particle motion is established by reciprocating motion of the particle container within the solution in a manner which establishes a back-and-forth flow of solution through the container. This is readily accomplished through use of a hollow cylinder having a screened off portion thereof which acts as the particle container. The cylinder is attached to reciprocating drive means and a portion of the cylinder which extends beyond the particle container section is aligned with means within the solution container whereby as the cylinder moves in one direction in the solution a suction is created within the extended section which causes solution to flow in one direction through the screened section and when the cylinder moves in the opposite direction a pressure is created in the extended section which reverses the direction of flow of the solution through the screened section.

BRIEF DESCRIPTION OF THE DRAWING

The FIGURE is a schematic representation of apparatus useful in the practice of the invention.

DESCRIPTION OF THE PREFERRED EMBODIMENTS

Apparatus useful for electroless plating of metals on discrete microsized particles is shown schematically in the FIGURE. The individual particles 1 to be coated are confined in a cylindrical plating chamber 2, the bases of which are screens 3, 4 with interstices smaller than the smallest diameter particle to be coated. Particles 1 to be coated are inserted into plating chamber 2 through fill port 9. Attached above coating chamber 2 is overflow chamber 5 with overflow ports 6, 7 located in the top portion thereof. Pressure chamber 8 is attached below chamber 2. The length of chambers 2, 5 and 8 is not critical; however, in a preferred embodiment the length of chamber 5 is 0.5 of the length of chamber 2 while the length of chamber 8 is 1.5 the length of chamber 2. Chambers 2, 5, and 8 in combination form a rigid cylinder 10 which is attached to mechanical or pneumatic direction reversible drive mechanism 11 by connecting rod 12. Cylinder 10 is immersed in an electroless plating solution 20 contained in tank 21. Substantially centered on the bottom 22 of tank 21 is a stationary vertically extending piston 23. Pressure chamber 8 is adapted to form a concentric sleeve around piston 23. Drive mechanism 11 and tank 21 are held in properly disposed relationship by means of support structure 24.

In a preferred embodiment mechanism 11 is a pneumatic drive. Air from air supply 13 is fed alternately through solenoids 14 and 15 into cylinder 16 through entry ports 17 and 18, respectively. The operation of solenoids 14 and 15 is controlled by timer 19. When cylinder 16 is pressurized through entry port 18 by solenoid 15, piston 25 which is attached to connecting rod 12 is driven upward until it meets stop 26. Solenoid 14 is then actuated which in turn causes piston 25 to descend within cylinder 16. The direction reversing cycle is adjustable from 1 to 10 seconds. The reciprocating action of piston 25 imparts the same reciprocating motion through connecting rod 12 to cylinder 10. This results in chamber 8 moving up and down on piston 23. The stroke length of the reciprocating motion is such that cylinder 10 remains completely submerged in plating solution 20 even at the maximum extent of the upward stroke. The reciprocating action initiates movement of plating solution 20 through reaction chamber 2 which in turn imparts substantially random motion to particles 1 during autocatalytic metal deposition. When the motion of piston 25 is downward, plating solution 20 is forced through screen 4 into reaction chamber 2 which in turn rotates, lifts, and disperses particles 1. When the motion of piston 25 is upward, plating solution flows by suction into reaction chamber 2 through screen 3 which disperses floating particles 1 through the coating solution within chamber 2. In the case of an electroless deposition in which gas evolution occurs, the downward stroke of piston 25 forces the liberated gas through screen 3, thereby assuring that reaction chamber 2 is filled with plating solution. The motion thus imparted to particles 1 by the reciprocating motion of cylinder 10 on piston 23 is sufficiently random that agglomeration or bridging is almost completely prevented and a uniform thickness of metal is deposited on particles 1.

It is preferred that material in contact with plating solution 20, as, for example, the walls of chamber 2, 5, and 8, be of a rigid plastic such as an acrylic or polycarbonate. Confining screens 3 and 4 are preferably made of silk, nylon, or polyester.

EXAMPLE 1.

In the apparatus of the FIGURE, a nickel-copper-phosphorous alloy was plated onto nickel-manganese microcapsules in the size range of 150 to 210 μm in diameter by electroless techniques. These microcapsules are commercially available under the tradename Solacells from the Solar Division of International Harvester Corporation. The electroless plating formulation used was: T,60

Niculoy 22 M and Niculoy 22 S are tradenames for reagents manufactured and sold by the Shipley Company. The bath temperature was maintained between 88° and 91° C, and the run duration was 150 minutes. With approximately 90,000 Solacells in reaction chamber 2 and a half cycle time of 1 sec for pneumatic drive 11, the average deposit thickness was 22 μm. The alloy thus plated on the Solacells had a composition of about 12% phosphorous, 1% copper, with the remainder nickel.

EXAMPLE II.

In the apparatus of the FIGURE, a nickel-phosphorous alloy was plated onto Solacells in the size range of 150 to 210 μm in diameter. The plating formulation was prepared by mixing one part of Lectroless NI liquid concentrate with two parts water. Lectroless NI is a tradename for an electroless plating formulation manufactured by the Sel-Rex Company which contains one ounce of nickel per gallon. The bath temperature was maintained between 90° and 92° C. and the pH was adjusted to 6.0 by addition of ammonium hydroxide. The duration of the run was 30 minutes. With approximately 90,000 Solacells in reaction chamber 2 and a half cycle time of 1 sec for pneumatic drive 11, the average deposit thickness was 8 μm. The alloy thus plated on the Solacells had a composition of about 0.5 to 2.0% phosphorous, with the remainder being nickel.

The foregoing examples serve merely to exemplify the invention and are in no way intended to limit its scope. The apparatus of the invention may be used with any metal capable of being deposited by electroless techniques. The density of the microsized particles being coated is not critical and may be less than, equal to, or more than that of the plating solution. Although the microcapsules coated in the foregoing examples are spherical, the apparatus of the invention may also readily be used to coat discrete, microsized particles which are irregular in shape.

What I claim is:

1. Apparatus for electroless plating discrete, microsized particles with a uniformly thick coating of a material which may be deposited by electroless techniques which comprises:

(a) means for containing a solution of a material useful for electroless plating, (b) the solution contained in said containment means, (c) particle containment means submerged within said solution for containing a plurality of said discrete, microsized particles, said means for containing said particles having first and second screened openings opposed therein with the interstices of said screened openings of a size which permits free flow of solution therethrough but which does not permit the passage of said discrete, microsized particles therethrough, said particle containment means comprising a first hollow cylinder with said first and second screens at the ends thereof, and (d) motor means for establishing a reciprocating motion of said particle containment means within said solution, said reciprocating motion being substantially along the axis of said opposed screened openings in said first hollow cylinder, wherein said motor means is connected to one end of a reciprocating drive means, said reciprocating drive means being connected at its other end to a second hollow cylinder, said second hollow cylinder being joined to one screened end of said first hollow cylinder and of substantially the same diameter as said first hollow cylinder, and (e) piston and cylinder means axially aligned with said first and second hollow cylinders for forcing said solution from within said cylinder means and into said first hollow cylinder when said hollow cylinder is moving toward said piston means and for creating a suction within said cylinder means and drawing solution thereto from within said first hollow cylinder when said first hollow cylinder is moving away from said piston means, said cylinder means being attached to the other screened end of said first hollow cylinder.

* * * * *